United States Patent [19]

Colautti

[11] 4,189,313

[45] Feb. 19, 1980

[54] CARBOTHERMIC PROCESS

[75] Inventor: Franco Colautti, Ragosa di Povoletto ud, Italy

[73] Assignee: Kinglor Metor S.p.A., Buttrio, Italy

[21] Appl. No.: 821,906

[22] Filed: Aug. 4, 1977

Related U.S. Application Data

[62] Division of Ser. No. 585,486, Jun. 10, 1975, abandoned.

[30] Foreign Application Priority Data

Jun. 11, 1974 [IT] Italy ..... 83365 A/75
Apr. 24, 1975 [IT] Italy ..... 83361 A/75

[51] Int. Cl.[2] ..... C21B 13/02
[52] U.S. Cl. ..... 75/37; 75/90 R
[58] Field of Search ..... 75/33–38, 75/26, 91, 90 R; 266/196

[56] References Cited

U.S. PATENT DOCUMENTS

| | | | |
|---|---|---|---|
| 1,372,483 | 3/1921 | Collins | 75/91 UX |
| 1,846,530 | 2/1932 | Smith | 75/37 |
| 2,996,373 | 8/1961 | Agarwal | 75/34 |
| 3,895,782 | 7/1975 | de Delas y de Ugarte | 266/186 X |

FOREIGN PATENT DOCUMENTS

| | | | |
|---|---|---|---|
| 2246156 | 3/1973 | Fed. Rep. of Germany | 266/197 |

*Primary Examiner*—M. J. Andrews
*Attorney, Agent, or Firm*—A. W. Breiner

[57] ABSTRACT

A carbothermic process and apparatus for converting iron ore directly to sponge iron in a vertical retort is described. A reaction charge of iron ore, reducing agent, and additives if employed is charged to a vertical retort having in reciprocal cooperation and coordination as a first stage a pre-heating operation wherein the reaction mixture descends in the retort at a constant speed, the heating being by combustion gases of the retort stack; as a second stage a progressive heating operation utilizing burners to initiate reduction of the reaction mixture, the speed of descent of the mixture becoming progressively slower followed by, as a third stage, a heating operation wherein the temperature is maintained constant with the use of burners to complete the reduction of the reaction mixture, the speed of descent of the mixture becoming progressively slower, and wherein the maximum temperature is kept substantially constant in at least a part of the second stage and in the third stage, and wherein the withdrawal of the sponge iron is controlled to control the speed of descent in the various stages. The process and apparatus provides sponge iron of high grade at a reasonable cost and in reasonable operating times.

13 Claims, 1 Drawing Figure

CARBOTHERMIC PROCESS

Figure 1:
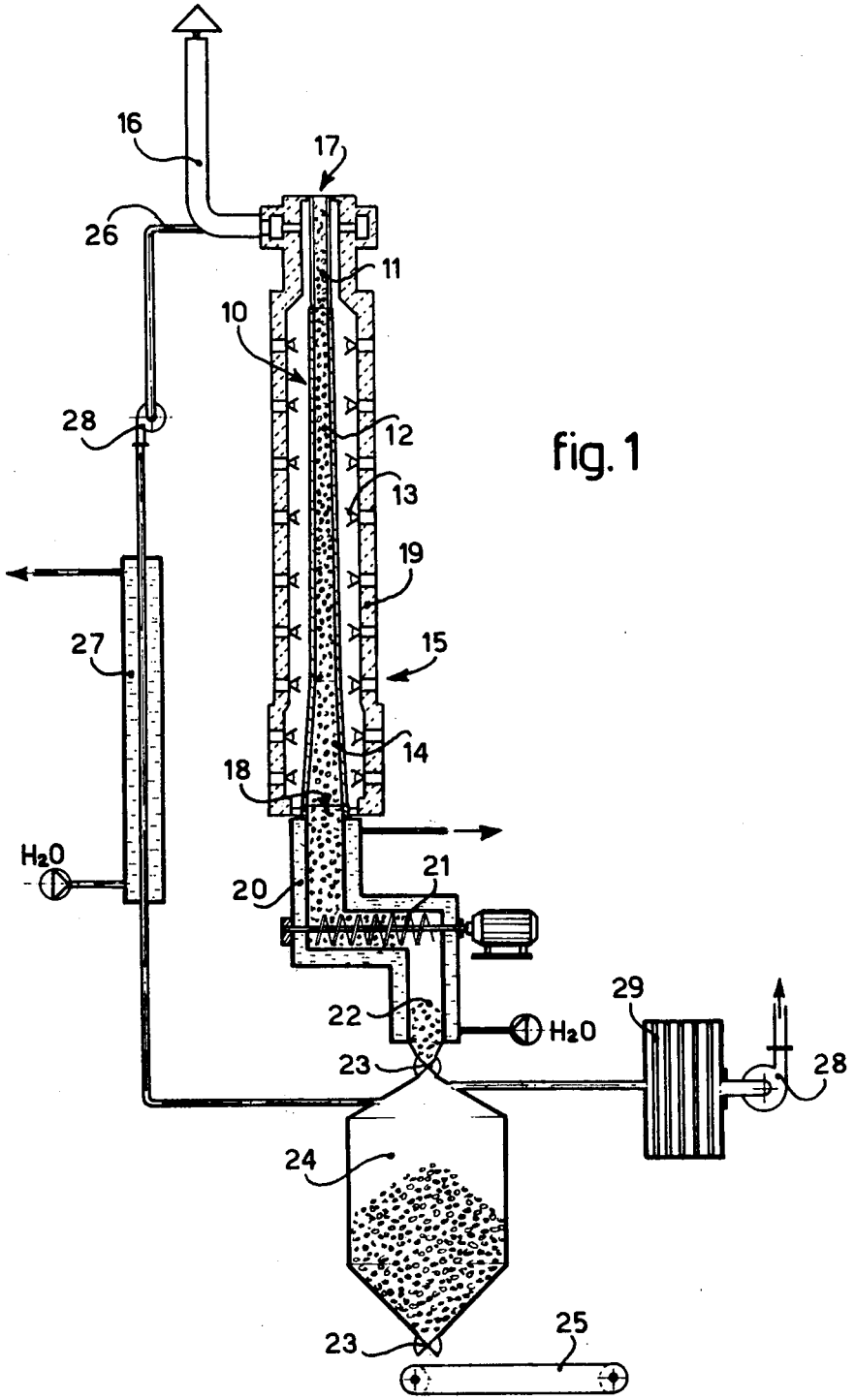

This is a division of application Ser. No. 585,486 filed June 10, 1975, now abandoned.

The present invention is directed to improvements in a carbothermic process of a type using external heating to obtain sponge iron starting with iron ore.

More precisely, the basic process to which the present improvements relate introduces a mixture of ore and coal from above into an externally heated, vertical retort furnace and withdraws at the bottom sponge iron together with ashes, coal dust, and coal, the whole having been previously cooled. The sponge iron is then separated magnetically from the impurities and from the still active coal, which is then re-cycled.

The production of sponge iron by direct reduction of ore with coal is a process which has been known since ancient times. However, these processes have known disadvantages and up to now no such process has been carried out on an industrial scale. One plant earlier in operation using the known Echevarria method has been recently closed down. The manifold difficulties associated with these processes include the following:

- the long time the ore is retained in the retorts, ranging from as high as 45 to 48 hours down to a minimum of 30 to 36 hours;
- low productivity per cubic meter of retort;
- consumption of large quantities of the substance used for heating the retort externally;
- considerable wear on the retorts owing to the presence of aqueous vapors and other corrosive reactions;
- inability to treat determined iron ores such as natural magnetites;
- sintering of the sponge iron, and
- low thermal efficiency.

The above and other unfavorable factors have made it impossible to use on an industrial scale the methods so far known for reduction of iron ore to produce sponge iron in an externally heated vertical retort.

It is, therefore, a primary object of this invention to provide a process of producing sponge iron from iron ore in a vertical retort on an industrial scale. In accordance with the invention, the charged material, i.e., iron ore; reducing material and additives if desired; is as intimately mixed as possible so as to improve the homogeneity of the reducing means with the ore to be reduced. Next, the charge or mixture is, as far as possible, freed from humidity or moisture before reaching the actual retort itself. With a view to providing the above, the process proposed arranges a first pre-heating stage which drys the components of the mixture completely; removes volatile substances, and serves to eliminate any water contained in the mixture itself. The charge which is introduced descends at a first constant or virtually constant speed (drying phase) and afterwards descends at a second speed which has a constant function of reduction of the speed of descent. The constant or virtually constant function of reduction of the speed substantially coincides with and conditions three phases as follows:

- bringing the mixture to the temperature for initiating the reduction reaction;
- initiating the stoichiometric process of reduction, thus obtaining $Fe_3O_4$ in the case of haematite ($Fe_2O_3$), and
- obtaining FeO.

Thereafter the speed of descent of the mixture is reduced in accordance with a constant function greater than the preceding function. This third descent phase coincides substantially with the phase of reduction from FeO to Fe. The last phase still has almost the same requirement for heat as the previous phases and takes place during a much longer period; that is to say, it takes place more slowly. Furthermore, during this third phase it is necessary to prevent the various elementary pieces of sponge iron which are being formed from adhering to each other. In accordance with the present invention a different method of external heat treatment coincides with each phase of the stoichiometric process of reduction. Further, in accordance with the present invention, it is advantageous to use burners with a front radiation bowl. Also, a variant to the process includes the using of the waste gases to pre-heat the air used by the heating means. The employment of the front radiation bowl, which is made incandescent by the flames, makes it possible to recover the heat of radiation.

In accordance with the present invention the external heating is realized by means of rings of burners. These rings are preferably at right angles to the vertical axis of the retort and enclose the whole height of the retort itself apart from the pre-heating zone, which is heated advantageously with the gases of combustion. The rings of burners may be regulated one by one or in groups. Each group of rings covers a well-defined vertical zone of the retort, a zone coinciding substantially with a phase of transition in the stoichiometric process of reduction.

Therefore, the improvements to the carbothermic process for reducing iron ore with the use of an externally heated vertical retort, whereby the mixture of coal, ore, and any activating and/or desulphurizing agent is introduced from above and wherein it is possible to inject reducing gases at any desired height and wherein there may also be a cooling zone and some means for extracting sponge iron and excess coal and ashes below the reduction zone, are realizable in that there are present in the retort in reciprocal cooperation and coordination:

- a first upper pre-heating zone, which has a substantially constant section and speed of descent of the charge;
- a second heated zone, which begins immediately below said first zone and initiates the reaction and first reduction, this second zone having a progressively larger section and a progressively lower speed of descent of the mixture;
- at least one third heated reduction zone, which begins below said second zone and has a progressively larger section and a progressively slower speed of descent of the mixture than said second zone, and
- a maximum optimum temperature, which is kept substantially constant in at least part of said second zone and in the whole of said third zone, wherein said first zone is heated with the gases of combustion, and said second and third zones are heated with direct heating means.

A specific embodiment is as follows:

Using haematite having an index of reducibility higher than 90, the pieces or granules of the ore preferably have a diameter of between 5 mm. and 25 mm. The best results have been obtained with an average granule size of 15 to 20 mm. The granule size of the coal, in the case of coke having 80 percent fixed carbon with an index of reactivity of 0.55 is preferably between about 5 and 30 mm. The best results have been obtained with a granule size of the order of 5 to 15 mm. The ore fines, that is, the dust or pieces with sizes below 5 to 6 mm., preferably are not introduced loose into the mixture of the charge unless they have been made into briquettes or have been pelletized. In accordance with one variant to the process, instead of the charge indicated a charge with briquettes or pellets already containing the ore, the reducing coal, and any activating and/or desulphurizing agent of a known type may be used. In accordance with a second variant, the briquettes or pellets may be mixed with excess coal.

In the retort the charge is first dried completely by taking it up to a temperature of about 400° C. in the pre-heating zone so that later in a subsequent part of the retort there will be no steam (water). The pre-heating zone is made advantageously of refractory steel. The retorts preferably have a substantially rectangular section and have two opposite sides substantially parallel to and equidistant from each other throughout their whole height, while the other two sides form substantially three large zones. The zones, as noted above, coincide with well-defined phases or groups of phases. In the highest, or uppermost, zone, where the retort is externally heated with combustion gases, the section is substantially constant and should have a proportion between the long side and the short side of about 1:5 to 1:8.5, and advantageously of about 1:6. A constant or almost constant speed of descent coincides with this constant section. The optimum speed of descent in the various zones varies with the ore or type of reducing coal being used. In the case of the haematites and coals previously indicated and having the average granule size indicated, the speed of descent is preferably about one meter and one to two meters or two meters per hour. Good results have been obtained with a speed of descent of 1.3 to 1.5 meters per hour. The parameters which link the height of this zone to the speed of descent coincide with a final temperature of about 400° C. for the mixture as the latter reaches the end of the pre-heating zone. One skilled in the art can select the proper speed based on the above.

The next or second zone, i.e., the zone where the change from $Fe_2O_3$ to $Fe_3O_4$ to FeO occurs, has, as noted, a vertical section that increases as it goes downwards. The section at the bottom of the zone corresponds with an average optimum speed of 0.80 to 0.90 meters per hour in the case of a mixture of the type indicated whose average speed in the pre-heating zone is about 1.3 to 1.5 meters per hour. Heating by means of rings of burners is carried out advantageously only on the long sides, the short sides being lapped by the combustion gases. The rings of burners are distributed in such a way as to provide uniform heat in accordance with the heating requirements of the reduction process during the various reduction phases.

In accordance with the present invention, at the beginning of the second quarter of the first zone which follows the pre-heating zone, i.e., the second zone, the temperature of the mixture should be about 850° to 900° C. so as to ensure the initiation of the reduction reaction. Towards the middle of said first zone the optimum temperature is about 1000° to 1030° C., with a maximum of 1050° C. The last or lower zone, which has the second constant function of enlargement of its section and has the sections and entry speed noted above, is characterized by an exit speed of about 0.50 to 0.55 meters per hour. In this zone, too, as we have said previously, the heating is carried out along the two long sides. In this last part the external heating serves only to maintain homogeneously the optimum temperature inside the mixture, and this temperature is about 1000° to 1030° C., with a maximum of 1050° C., in the case of a mixture as previously detailed.

In an industrial-scale plant the following results have been obtained. The ore and coal used for the batch were of the type previously noted. The average content of the ore introduced was as follows:

63 to 64 percent iron, 90 to 91 percent haematite $Fe_2O_3$. After remaining in the retort (for pre-heating and reduction) for 12 to 13 hours, the sponge iron obtained had a total iron content—iron metal plus FeO—of about 87–88 percent with a degree of metallization, that is, ratio between iron metal and total iron, equal to about 92 percent, which means that out of all the iron present in the sponge about 80 percent is iron metal. These results were obtained with the average speeds previously indicated, which have provided a productivity of about 60 to 70 Kgs/cu. meter per hour.

It is noted that the ore and the coal used in the experiments were not of the best grades. When briquettes or pellets are used, the consequent results are better and can be further improved by the presence of a reaction activating agent. Briquettes of the self-reducing type, furthermore, provide the advantage that it is possible to adjust their composition and the charge, thus obtaining at the outlet sponge iron which is substantially free from appreciable, accompanying impurities.

The withdrawal of the sponge iron, in accordance with the invention, should be such as to ensure uniformity of descent in any horizontal section of the retort. This is so because a non-homogeneous descent involves stay times and, therefore, degrees of metallization differing from one zone to another. Moreover, there is the danger of adhesion or sintering.

In accordance with the invention the sponge iron leaving the withdrawal means is temporarily stored in a first chamber that has at its base a cut-off shutter. The sponge iron is then sent from said first chamber into a second chamber kept under extra pressure so that, every time said shutter opens, the CO present in said first chamber is unable to go out. The extra pressure in the second chamber is realized with inert gas.

The inert gas employed consists advantageously of gases drawn from the stack (at about 850° to 950° C.), cooled to the ambient temperature (about 20° to 40° C.) and introduced into said second chamber. These inert gases also fulfill the purpose of preventing oxidation of the sponge.

The excessive inert gases are then caused to pass through dust-removing baffle plates and are discharged into the atmosphere.

With regard to the above, reference is made to the attached drawing which in a diagrammatic manner illustrates a plant which adopts the improvements of the present invention.

In the drawing, 10 refers generally to the retort. 11 is the upper pre-heating zone. 12 is the first zone externally heated with burners 13. 14 is the second externally heated zone. 17 is the entry inlet. 18 is the exit outlet of the retort. 19 is the support structure containing the chamber 15 and sustaining the burners 13. 20 is the zone that cools the sponge iron, the cooling being realized by means of forced circulation of water in the interspaces. 21 designates screw-type withdrawal means. 22 is the first chamber for holding the sponge iron. 23 designates the shutters. 24 is the second chamber for holding the sponge iron. 25 is a possible conveyor belt for withdrawing the sponge iron. 26 is the means for drawing gases from the stack 16. 27 is the circuit for cooling the gases. 28 designates the means for blowing the gases. 29 designates the filtering baffle plates.

Although the above describes the improvements relating to the invention and the resulting reduction process, some variants are possible. It is possible to act on the speeds of descent and to keep the sections and/or heights unvarying. It is possible to heat all sides of the retort. It is also possible to provide in the charge some means for activating the stoichiometric process of reduction or some desulphurizing means or other means necessary for the purpose. Thus, it is possible to inject gaseous reducing agents at a temperature and at heights desired. It is possible to heat the pre-heating zone directly and it is possible to use the combustion gases for pre-heating the combustion air. These and other variants are possible without departing from the scope of the inventive idea expressed herein.

It is claimed:

1. A carbothermic process for converting iron ore directly to sponge iron comprising the steps of charging a reaction mixture comprising iron ore to be reduced and a reducing agent at the top of a vertical retort comprising first, second, and third reaction zones; pre-heating said reaction mixture in said first reaction zone to a temperature below the reduction temperature of the iron ore of said reaction mixture by means of combustion gases from said retort to eliminate any water content which may be present in said reaction mixture and maintaining the speed of descent of the reaction mixture constant within said first zone as said charge flows to said second zone; increasing the heat of said second reaction zone in relation to said first zone, by use of external burners to provide uniform heat within any section of said zone, to a temperature sufficient to initiate the reduction of the reaction mixture and varying said heat in different sections within said second zone while causing the speed of descent of the reaction mixture within said second zone to become progressively slower as said reaction mixture flows to said third zone; maintaining said third zone at a constant reduction temperature by use of external burners and causing the speed of descent of said mixture within said third zone to become progressively slower to thereby complete the reduction of the reaction mixture in said third zone, and controlling the withdrawal of the sponge iron from said retort to coordinate the descent of the reaction mixture through said first, second, and third zones to obtain substantially complete reduction.

2. The process of claim 1, wherein the maximum temperature of reduction is reached in said second zone and maintained constant over at least a part of said second zone.

3. The process of claim 1, wherein the reaction mixture includes additives in addition to the iron ore and reducing agent.

4. The process of claim 3, wherein the additives are activating and desulphurizing agents.

5. The process of claim 1, wherein the mixture is a homogeneous mixture and the components have dimensions of at least 5 mm.

6. The process of claim 1, wherein the reaction mixture comprises haematite having an index of reducibility of about 90 to 92 percent and coke having about 80 percent fixed carbon and a reactive index of 0.55, the granule size of the haematite being from about 5 to 25 mm. and the granule size of the coke being from about 5 to 30 mm.

7. The process of claim 1, wherein the temperature in the pre-heating zone is maintained at about 400° C.

8. The process of claim 1, wherein the reaction mixture through the vertical retort is controlled so that there is a substantially constant progression of increase in the section of said second zone with a progressive reduction in the speed of descent to correspond to the reaction times of the reduction process to ensure substantial total reduction of ore.

9. The process of claim 1, wherein the speed of exit from the third zone is from about 0.40 and 0.80 meters per hour.

10. The process of claim 1, wherein the temperature of reduction in said second and third zones is at a maximum of 1050° C.

11. The process of claim 1, whereby the withdrawal of sponge iron from the lower part of the retort is carried out in order to maintain a substantially constant speed of descent in the area of any horizontal plane thereabove.

12. The process of claim 1, whereby the sponge iron withdrawn from said retort is delivered into a first chamber and therefrom through a gate into a second chamber maintained under pressure with inert gas.

13. The process of claim 12, whereby the second chamber is kept under pressure with combustion gases drawn from the retort and cooled to ambient temperature.

* * * * *